US010462553B2

(12) United States Patent
Matsumura et al.

(10) Patent No.: US 10,462,553 B2
(45) Date of Patent: Oct. 29, 2019

(54) SPEAKER DEVICE

(71) Applicant: Panasonic Intellectual Property Management Co., Ltd., Osaka (JP)

(72) Inventors: Toshiyuki Matsumura, Osaka (JP); Akihisa Kawamura, Osaka (JP); Shuji Saiki, Nara (JP)

(73) Assignee: PANASONIC INTELLECTUAL PROPERTY MANAGEMENT CO., LTD., Osaka (JP)

( * ) Notice: Subject to any disclaimer, the term of this patent is extended or adjusted under 35 U.S.C. 154(b) by 0 days.

(21) Appl. No.: 15/901,898

(22) Filed: Feb. 22, 2018

(65) Prior Publication Data

US 2018/0279039 A1 Sep. 27, 2018

(30) Foreign Application Priority Data

Mar. 27, 2017 (JP) ..... 2017-061924

(51) Int. Cl.

*H04R 1/24* (2006.01)
*H04R 1/28* (2006.01)
*H04R 1/02* (2006.01)

(52) U.S. Cl.

CPC ..... *H04R 1/24* (2013.01); *H04R 1/025* (2013.01); *H04R 1/288* (2013.01); *H04R 1/2857* (2013.01); *H04R 2499/13* (2013.01); *H04R 2499/15* (2013.01)

(58) Field of Classification Search

CPC ..... H04R 1/24; H04R 1/288; H04R 1/2857; H04R 1/025

See application file for complete search history.

(56) References Cited

U.S. PATENT DOCUMENTS 3,918,551 A 11/1975 Rizo-Patron
4,336,861 A * 6/1982 Peter ..... H04R 1/26 181/144

(Continued)

FOREIGN PATENT DOCUMENTS

CN 204518043 U 7/2015
JP 55-072384 U 5/1980
JP 60-253399 A 12/1985

OTHER PUBLICATIONS

The Extended European Search Report dated May 17, 2018 for European Patent Application No. 18160615.3.

*Primary Examiner* — Sunita Joshi

(74) *Attorney, Agent, or Firm* — Greenblum & Bernstein, P.L.C.

(57) ABSTRACT

A speaker device includes a first speaker unit, a first cabinet that houses the first speaker unit, and an annular portion defining a sound path that guides sound radiated from the first speaker unit to outside the first cabinet, the annular portion being positioned on a sound radiation side of the first speaker unit and arranged so as to sound a diaphragm in the first speaker unit. The speaker device also includes a second cabinet arranged inside the annular portion and spaced apart from the sound path, the sound path being annular, and a second speaker unit that radiates sound in a direction in which the first speaker unit radiates sound and that is stored in the second cabinet. The speaker device further includes a resonant portion having an aperture communicating with the sound path and defining a resonant space.

10 Claims, 7 Drawing Sheets

(56) References Cited

U.S. PATENT DOCUMENTS

| | | | | |
|---|---|---|---|---|
| 6,493,452 | B1 * | 12/2002 | Koizumi | H04R 1/24<br>181/144 |
| 8,180,076 | B2 * | 5/2012 | Bastyr | H04R 1/2888<br>381/182 |
| 2017/0064421 | A1 * | 3/2017 | Matsumura | H04R 1/025 |

* cited by examiner

SPEAKER DEVICE

BACKGROUND

1. Technical Field

The present disclosure relates to speaker devices and in particular to a speaker device including a first speaker unit and a second speaker unit arranged in front of the first speaker unit.

2. Description of the Related Art

A speaker device including a pair of speaker units and made similar to a simple sound source by arranging them in its front-to-back direction, a so-called coaxial speaker device, has been disclosed (see, for example, Japanese Unexamined Utility Model Registration Application Publication No. 55-72384).

SUMMARY

Like the speaker device described in Japanese Unexamined Utility Model Registration Application Publication No. 55-72384, a coaxial speaker device in which a speaker unit for higher audio frequency sounds is arranged in the center of a frame of a speaker unit for lower audio frequency sounds and the frames of the pair of speaker units are connected together has a problem in that a diaphragm of the speaker unit for higher audio frequency sounds is shaken by the amplitude of a diaphragm of the speaker unit for lower audio frequency sounds, a sound including distortion (cross-modulation distortion) is radiated as a whole, and the sound quality as the speaker device is degraded.

One non-limiting and exemplary embodiment provides a speaker device including a pair of speaker units arranged in its front-to-back direction and capable of suppressing distortion occurring in the speaker device and improving the sound quality.

In one general aspect, the techniques disclosed here feature a speaker device including a first speaker unit, a first cabinet that houses the first speaker unit, a sound path that guides sound radiated from the first speaker unit to outside the first cabinet, the sound path being positioned on a sound radiation side of the first speaker unit and arranged annularly so as to sound a diaphragm in the first speaker unit, a second cabinet arranged inside the sound path and spaced apart from the sound path, the sound path being annular, a second speaker unit that radiates sound in a direction in which the first speaker unit radiates sound and that is stored in the second cabinet, and a resonant space having an aperture communicating with the sound path.

The present disclosure can provide techniques that enable radiating sound whose quality less varies with the hearing location and radiating high-quality sound with reduced distortion by arranging a first speaker unit and a second speaker unit in a front-to-back direction.

Additional benefits and advantages of the disclosed embodiments will become apparent from the specification and drawings. The benefits and/or advantages may be individually obtained by the various embodiments and features of the specification and drawings, which need not all be provided in order to obtain one or more of such benefits and/or advantages.

DETAILED DESCRIPTION

Embodiments of a speaker device according to the present disclosure will be described below with reference to the drawings. The embodiments below are merely illustrated as examples of the speaker device according to the present disclosure. The scope of the present disclosure is defined by the wording of the claims with reference to the embodiments below, and the present disclosure is not limited to the embodiments below. Constituent elements described in the embodiments below but not stated in the independent claims representing the broadest concept of the present disclosure are described as elements optional for achieving the objects of the present disclosure and included in preferred embodiments.

The drawings are schematic diagrams in which enhancement, omission, adjustment of proportions are performed for illustrating the present disclosure, and may illustrate shapes, positional relationships, proportions different from real ones.

Embodiments

Figure 1:
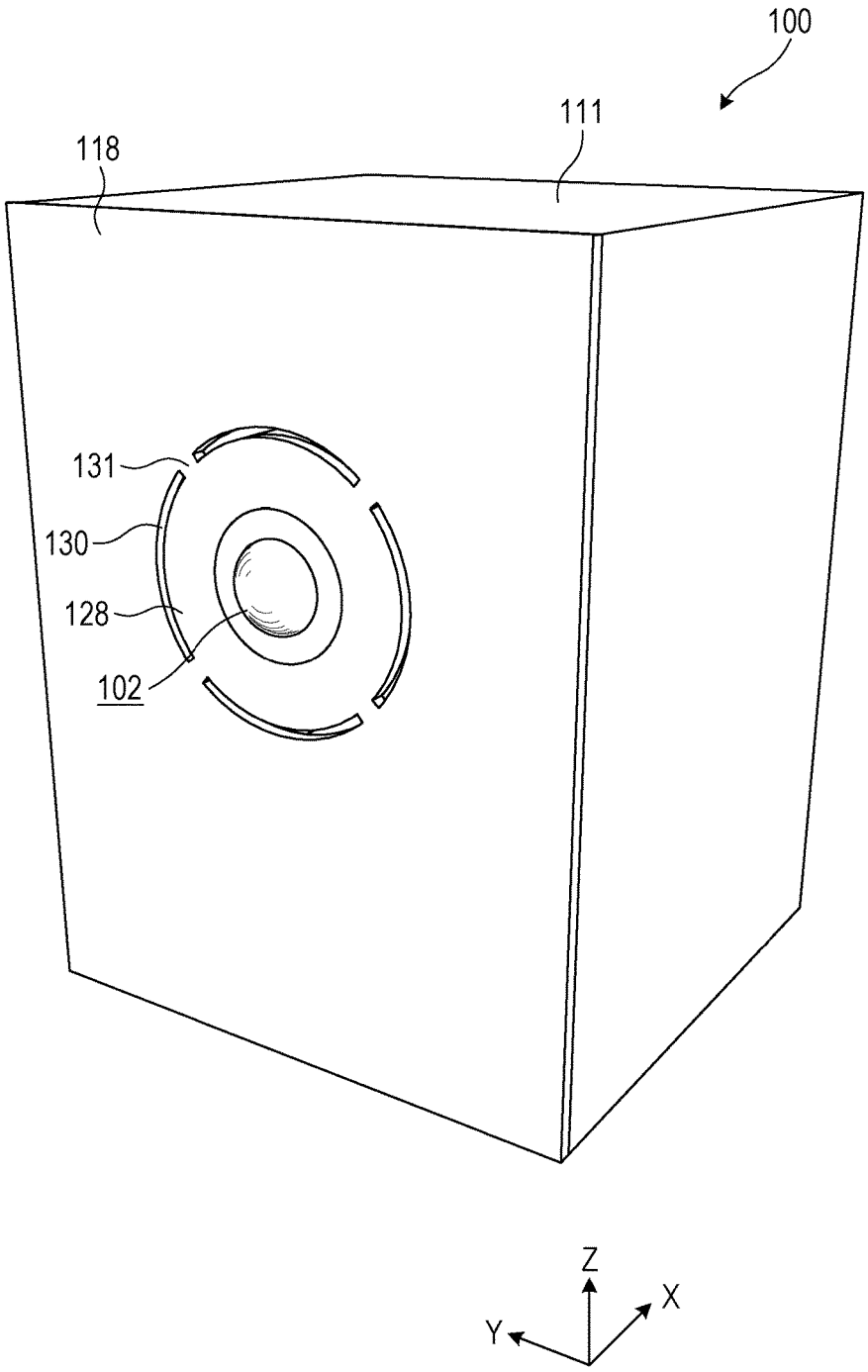
FIG. 1 is a perspective view that illustrates an outward appearance of a speaker device according to an embodiment.

FIG. 1 is a perspective view that illustrates an outward appearance of the speaker device according to an embodiment.

Figure 2:
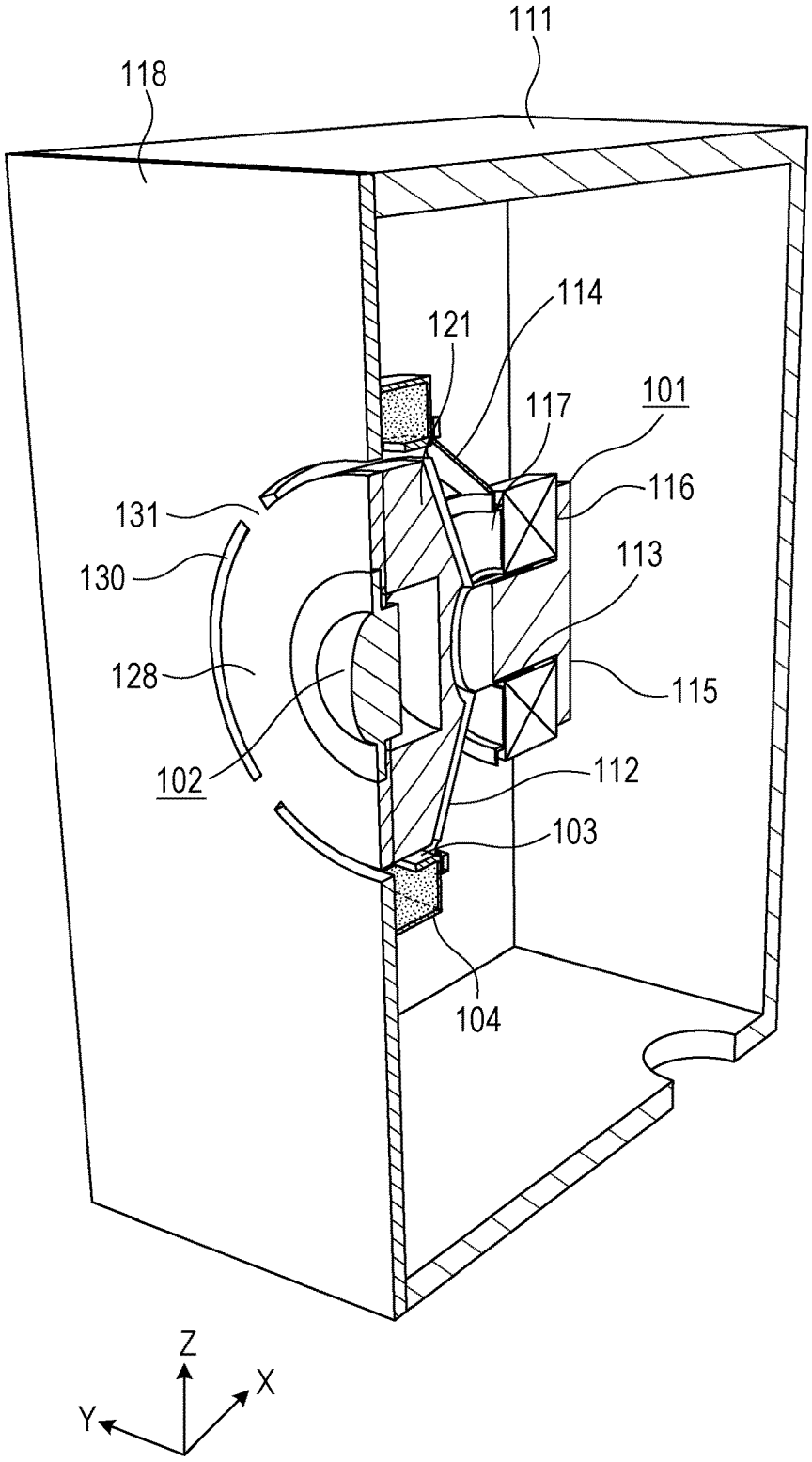
FIG. 2 is a cutaway perspective view that illustrates the inside of the speaker device according to the embodiment.

FIG. 2 is a cutaway perspective view that illustrates the inside of the speaker device according to the embodiment.

Figure 3:
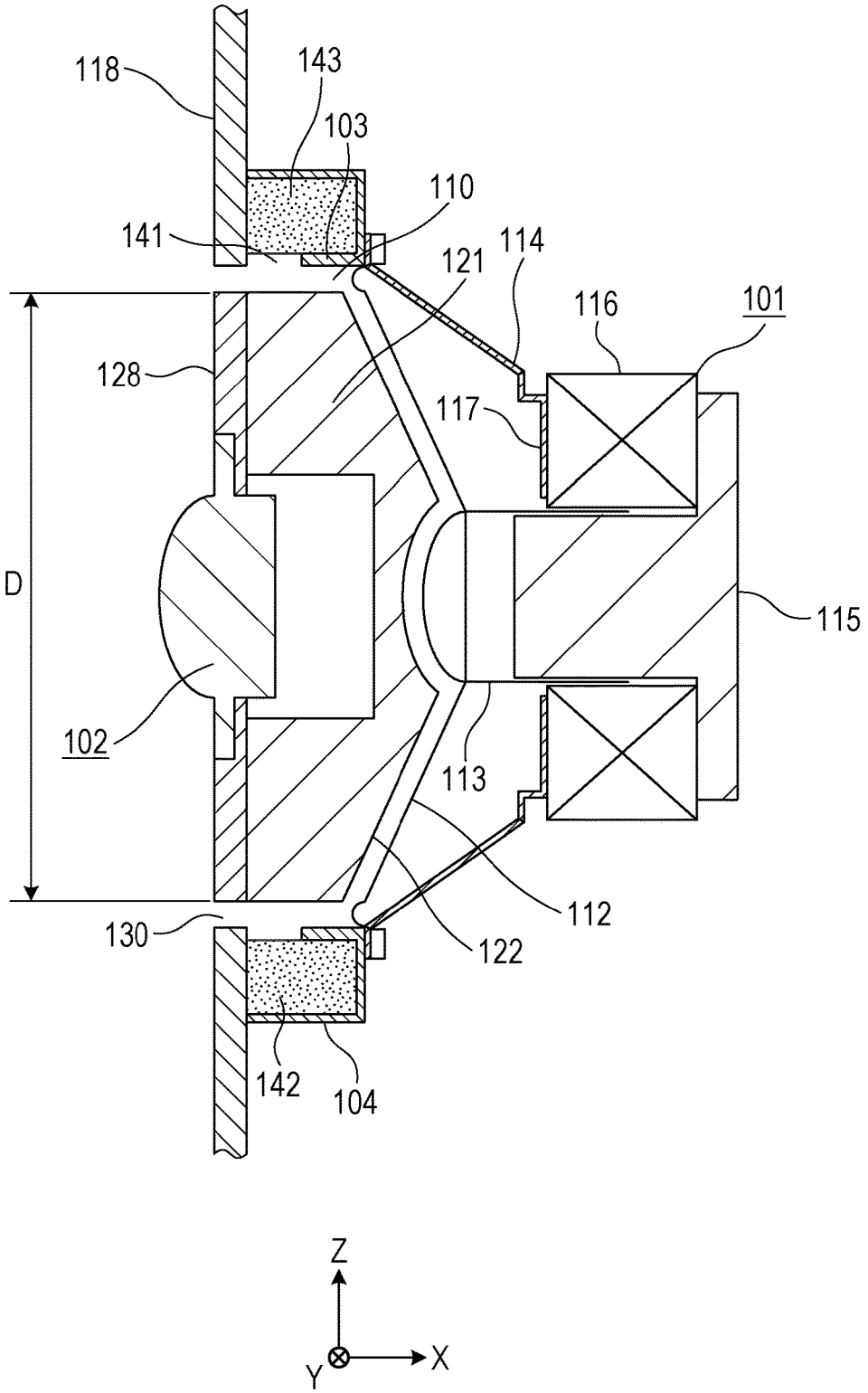
FIG. 3 is a cross-sectional view that illustrates a speaker unit area in the speaker device according to the embodiment.

FIG. 3 is a cross-sectional view that illustrates a speaker unit area in the speaker device according to the embodiment.

As illustrated in FIGS. 1 to 3, a speaker device 100 is a speaker in which two speaker units are arranged in its front-to-back direction (X-axis direction in the drawings) and includes a first speaker unit 101, a second speaker unit 102, a first cabinet 111, a second cabinet 121, an annular portion 103, and a resonant portion 104.

The first speaker unit 101 is a speaker designed to take charge of radiating sound in a lower frequency range than that for the second speaker unit 102 and is composed of a vibration system including a diaphragm 112, a voice coil 113, and a frame 114 and a field section including a yoke 115, a magnet 116, and a plate 117.

In the present embodiment, the first speaker unit 101 is housed in the first cabinet 111 and is attached to a first baffle plate 118 closing a front opening of the first cabinet 111 with the annular portion 103 disposed therebetween. The first speaker unit 101 may be supported on the first cabinet 111 with a support member or other similar members disposed therebetween.

The first speaker unit 101, which is illustrated as a typical speaker including a conical diaphragm in the present embodiment, is not limited and can be replaced with other known speakers.

The second speaker unit 102 is a speaker smaller than the first speaker unit 101 and designed to take charge of radiating sound in a higher frequency range than that for the first speaker unit 101. Like the first speaker unit 101, the second speaker unit 102 includes a diaphragm, a voice coil, a frame, a yoke, a magnet, a plate, and other elements, which are not illustrated.

The second speaker unit 102 is arranged in front of the diaphragm 112 in the first speaker unit 101 (on the negative side in the X axis in the drawings) so as to radiate sound in a direction in which the first speaker unit 101 radiates sound. The second speaker unit 102 is housed and supported in the second cabinet 121 arranged between the second speaker unit 102 and the diaphragm 112 in the first speaker unit 101.

In the present embodiment, the first speaker unit 101 and second speaker unit 102 are arranged such that their respective voice coils have a common axis and are in a so-called coaxial speaker arrangement.

The second speaker unit 102, which is illustrated as a typical speaker in the present embodiment, is not limited and can be replaced with other known speakers.

Figure 4:
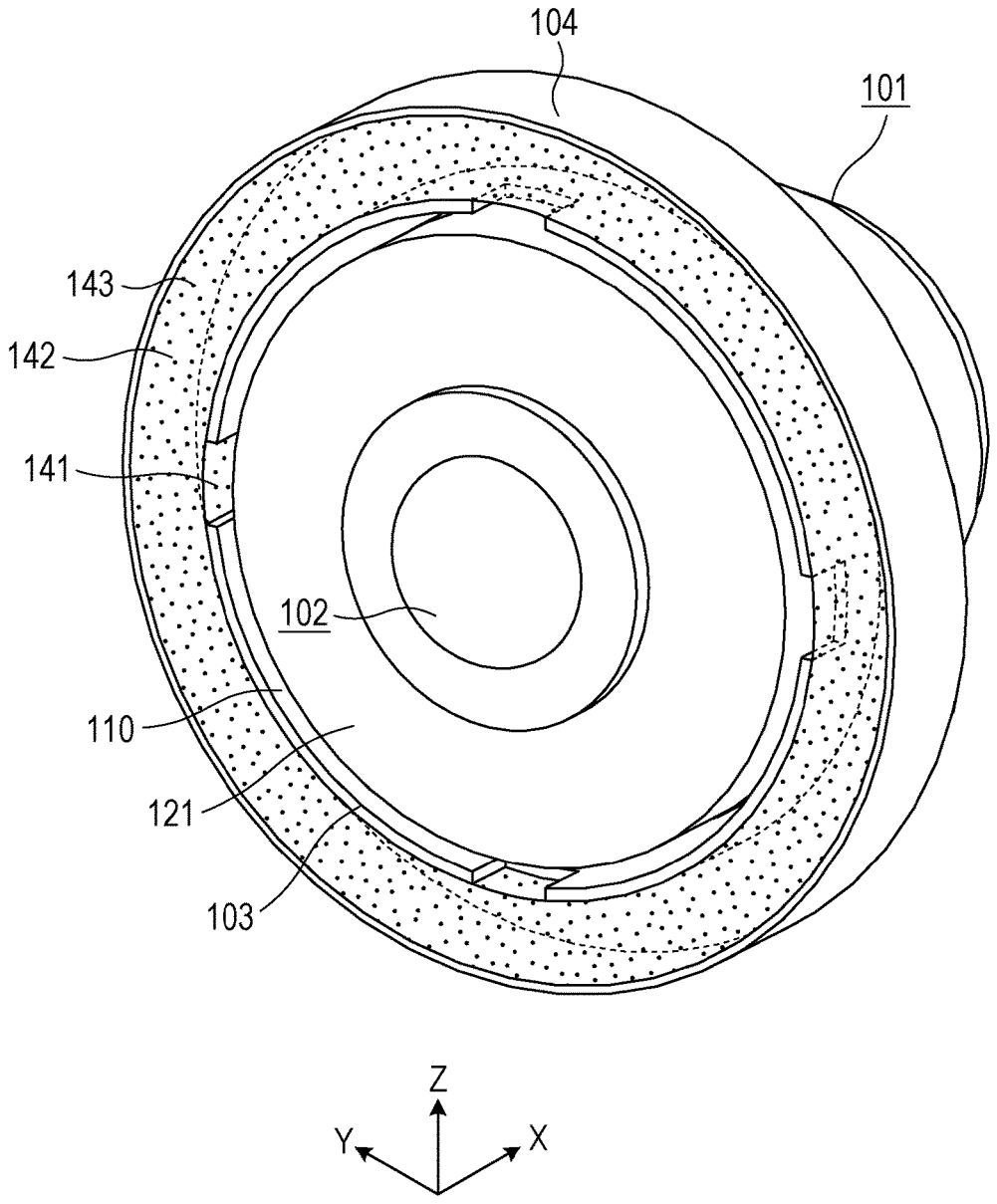
FIG. 4 is a perspective view that illustrates an annular portion, a resonant portion, and the speaker units according to the embodiment.

FIG. 4 is a perspective view that illustrates the annular portion, resonant portion, and speaker units.

As illustrated in FIG. 4, the annular portion 103 is an annular member that is arranged on the side from which the first speaker unit 101 radiates sound (on the negative side of the X axis in the drawing), that surrounds the diaphragm 112 in the first speaker unit 101 around the second speaker unit 102, and that guides sound radiated from the first speaker unit 101 to outside the first baffle plate 118 through an annular sound path 110 between the first cabinet 111 and second cabinet 121.

In the present embodiment, the diaphragm 112 in the first speaker unit 101 is conical in shape, and the annular portion 103 has a cylindrical shape with an inner diameter substantially the same as the diameter of the bottom surface of the diaphragm 112. The annular portion 103 has one or more openings (or cuts) functioning as one or more apertures 141 of the resonant portion 104 described below.

The resonant portion 104 has the apertures 141 communicating with the sound path 110 and defines a resonant space 142. In the present embodiment, the resonant space 142 is a space defined by the annular portion 103, resonant portion 104, and part of the first baffle plate 118 and closed other than the apertures 141, which communicate with the sound path 110.

The resonant portion 104, which is described as defining the resonant space 142 together with other members, may define the resonant space 142 alone.

The size of the resonant space 142 formed in a closed state by the resonant portion 104 and the size of the apertures 141 are set at any values in accordance with the frequency at which sound traveling through the sound path 110 resonates. Apart from the annular resonant space 142 surrounding the annular portion 103 in the present embodiment, a plurality of partitioned resonant spaces 142 may be included.

The number of apertures 141 may be any numbers and may preferably be more than one. With the plurality of apertures 141, they may preferably be positioned evenly spaced in the circumferential direction.

In the present embodiment, a sound absorber 143 (indicated by fine dots in FIG. 4) is arranged in the resonant space 142 defined by the resonant portion 104. The sound absorber 143 is a member that amplifies acoustic resistance and is made of a porous material. Examples of the porous material here includes not just a material in which bubbles are dispersed, such as resin sponge, but a material made of intertwined fibers, such as glass wool. The arrangement of the sound absorber 143 in the resonant space 142 enables adjusting the degree of suppression of resonance by the resonant space 142.

The second cabinet 121 is a member arranged inside the annular portion 103 and forming the annular sound path 110 together with the annular portion 103. The second cabinet 121 houses the second speaker unit 102 and also functions as a housing for forming an air chamber in the second speaker unit 102.

In the present embodiment, the second cabinet 121 includes a back-side portion 122 (see FIG. 3) conforming to the shape of the diaphragm 112 at a surface facing the diaphragm 112 in the first speaker unit 101.

The back-side portion 122 is at a position substantially nearest the diaphragm 112 in the first speaker unit 101 among positions where it does not interfere even when the diaphragm 112 vibrates to radiate sound. This enables effectively radiating sound from the diaphragm 112 to outside the baffle plate through the sound path 110.

In the present embodiment, a slit 130 communicating with the sound path 110 is present between the first baffle plate 118 at the front of the first cabinet 111 and a second baffle plate 128 at the front of the second cabinet 121, and the speaker device 100 radiates sound from the first speaker unit 101 to the outside through the slit 130.

In the present embodiment, a diameter D of the second baffle plate 128 (see FIG. 3) is set at a value equal to or larger than half of a wavelength calculated from a bass reproduction limit frequency for the second speaker unit 102. By this setting, the entire sound pressure characteristics based on sound radiated through the slit 130 and sound radiated from the second speaker unit 102 can be flattened. One example case is described below. When the bass reproduction limit frequency fL is 2000 Hz, the wavelength for 2000 Hz is 170 mm (=344 (speed of sound)/2000). Accordingly, the diameter of the second baffle plate 128 may preferably be equal to or larger than 85 mm, which is half of the wavelength.

Figure 5:
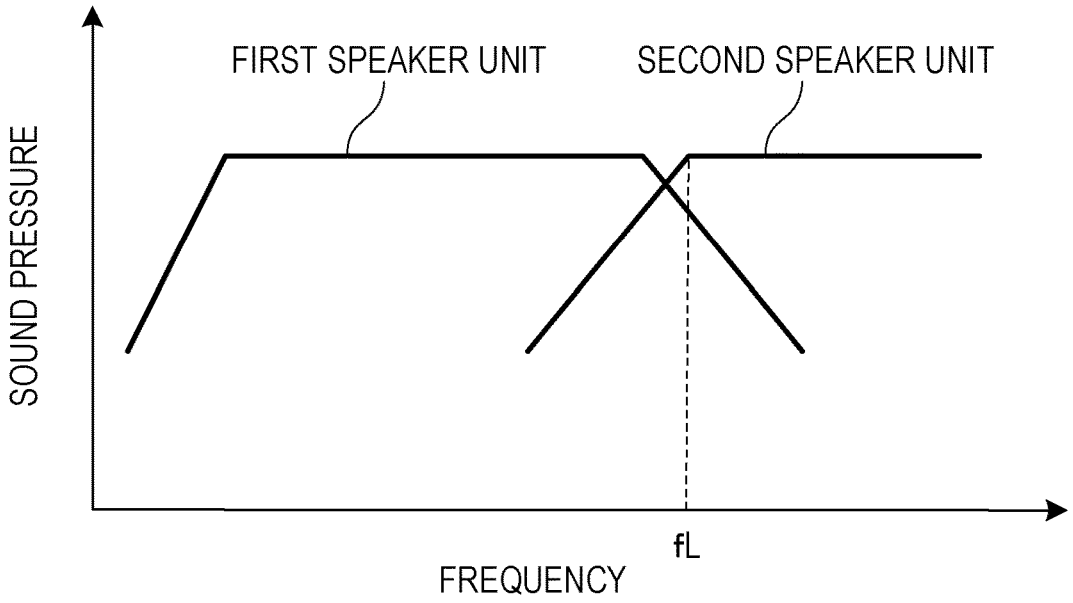
FIG. 5 is an illustration for describing a bass reproduction limit frequency.

The bass reproduction limit frequency here is a limit frequency of sound in the bass range that can be reproduced by the speaker unit. As schematically depicted in FIG. 5, the frequency fL, at which the sound pressure sharply decreases while the frequency of reproduced sound reduces, is the bass reproduction limit frequency.

The diameter is described in the specification and claims as being twice the shortest distance among distances from the point of intersection of the axis of the second speaker unit 102 and a surface including the front surface of the second baffle plate 128 to the outer edge of the second baffle plate 128 on that surface.

The front surface of the first baffle plate 118 and the front surface of the second baffle plate 128 are made flush with each other to improve the acoustic feature. The second baffle plate 128 is integral with the first baffle plate 118. That is, the first baffle plate 118 and second baffle plate 128 are formed by having the slit 130 penetrating through a single plate. Accordingly, the slit 130 is not entirely annular and is divided by one or more connection portions 131 connecting the first baffle plate 118 and second baffle plate 128.

The second cabinet 121 and second speaker unit 102 are supported on the first baffle plate 118 fixed to the first cabinet 111 only through the second baffle plate 128 and are arranged in front of the first speaker unit 101.

As described above, the speaker device 100 in the present embodiment can offer advantages in that it can radiate sound whose quality less varies with the hearing location, like sound radiated from a simple sound source, and also can radiate high-quality sound while suppressing the occurrence of cross-modulation distortion. Specifically, the occurrence of cross-modulation distortion can be suppressed by arranging the first speaker unit 101 and second speaker unit 102 on substantially the same axis and radiating sound emitted from the first speaker unit 101 from a location spaced a predetermined distance apart from the second speaker unit 102. By arranging the second cabinet 121, which is larger and heavier than the second speaker unit 102, at the front of the first speaker unit 101 and causing the surface of the second cabinet 121 facing the diaphragm 112 to conform to the shape of the diaphragm 112, sound from the first speaker unit 101 can be efficiently guided to the sound path 110, and the sound from the first speaker unit 101 can be radiated through the slit with a high degree of efficiency. Hence, the quality of sound radiated from the speaker device 100 as a whole can be enhanced.

The present disclosure is not limited to the embodiment above. Other embodiments in which constituent elements described in the present specification are combined or some constituent elements are omitted may be embodiments in the present disclosure. The present disclosure also includes variations obtained by performing various modifications conceivable by those skilled in the art on the above embodiment without departing from the principles and spirit of the present disclosure, that is, the meaning indicated by the wording of the claims.

Figure 6:
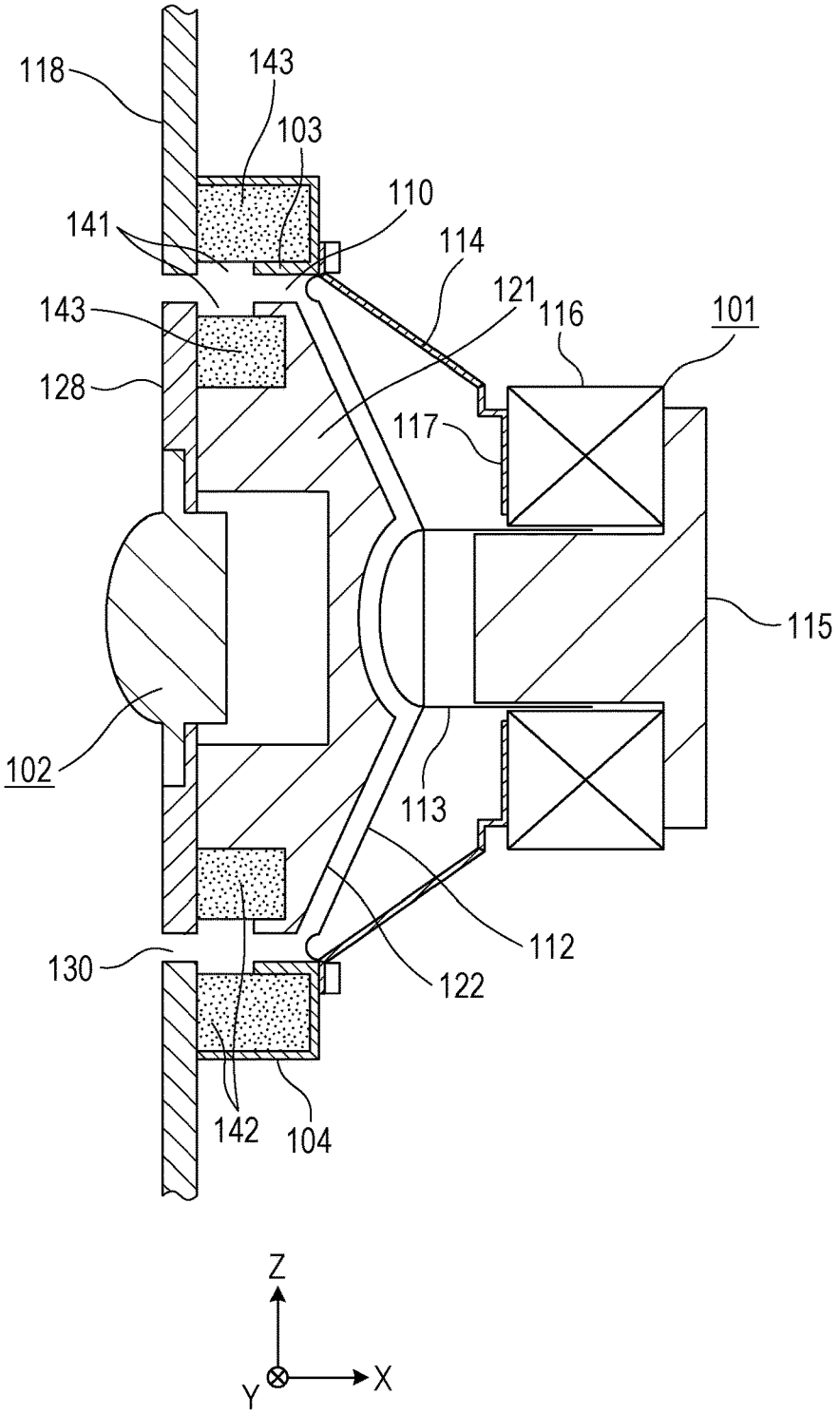
FIG. 6 is a cross-sectional view that illustrates another example of the speaker unit area in the speaker device.

For example, the resonant space 142 is present at least one of outside and inside the sound path 110. As illustrated in FIG. 6, the resonant space 142 inside the sound path 110 may be closed by the second cabinet 121 and second baffle plate 128 other than the aperture 141. The resonant space 142 may be defined by the resonant portion 104 being independent of a baffle plate, the cabinet, and other elements.

Figure 7:
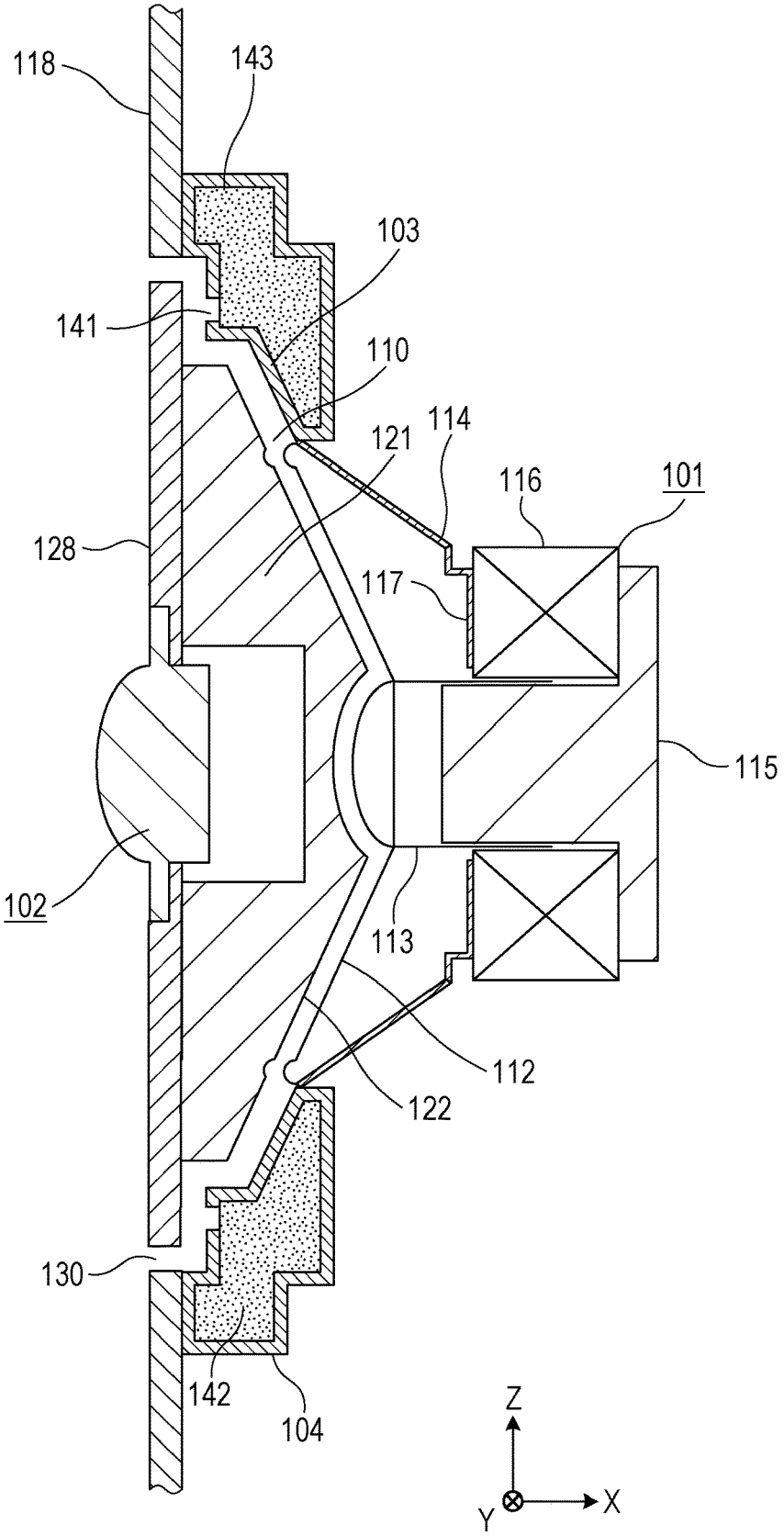
FIG. 7 is a cross-sectional view that illustrates still another example of the speaker unit area in the speaker device.

As illustrated in FIG. 7, the diameter of the sound path 110 near the second speaker unit 102 may be larger than the diameter thereof near the first speaker unit 101. Similarly, the annular portion 103 defining the sound path 110 is not limited to a cylindrical shape and may have a conical shape in part or in entirety.

The shape of the sound path 110 whose diameter increases in stages or continuously from the first speaker unit 101 toward the second speaker unit 102 leads to an increased diameter of the second baffle plate 128. Accordingly, the susceptibility of sound radiated from the second speaker unit 102, which deals with the higher frequency range, to the effects of radiation from the slit 130 can be reduced, and the degree of freedom in design of the speaker device 100 can be improved.

The diameter of the second baffle plate 128 may be smaller than the diameter of the diaphragm 112 in the first speaker unit 101.

The diaphragm 112 in the first speaker unit 101 is described as having a conical shape, but it is not limited to any particular shape. The diaphragm may have a flat shape. The diaphragm may have not only a circular or oval shape but also a rectangular shape.

The cabinet and baffle plate, which are described as separated elements, may be integral with each other. The first baffle plate 118 and second baffle plate 128 may be independent members that are joined with a joint member.

The first cabinet 111, which is described as an independent housing, may be a housing shared by an electronic device, such as a television or computer, or shared by a moving structure, such as a vehicle or airplane.

The present disclosure is applicable to a speaker device that reproduces audio signals of, for example, music.

What is claimed is:

1. A speaker device, comprising:

a first speaker that is housed in a first cabinet and is attached to a first baffle plate closing a front opening of the first cabinet with an annular portion disposed there between;

a second cabinet arranged inside the sound path and spaced apart from the sound path, the sound path being annular;

a second speaker that radiates sound in a direction in which the first speaker unit radiates sound and that is stored in the second cabinet;

a sound path that guides sound radiated from the first speaker to outside the first cabinet via a slit, the sound path being positioned on a sound radiation side of the first speaker and arranged annularly so as to surround a diaphragm in the first speaker, the slit being provided between the first baffle plate and a second baffle plate at the front of the second cabinet; and a resonant space that surrounds the annular portion and has an aperture that has one or more openings provided on the annular portion communicating with the sound path, wherein the resonant space suppresses a resonance of the sound that is radiated from the first speaker to outside the first speaker through the slit.

2. The speaker device according to claim 1, further comprising:

a sound absorber arranged in the resonant space.

3. The speaker device according to claim 1, wherein a diameter of the sound path near the second speaker is larger than a diameter thereof near the first speaker.

4. The speaker device according to claim 1, wherein the second cabinet has a back side facing the diaphragm in the first speaker and having a shape conforming to a shape of the diaphragm in the first speaker.

5. The speaker device according to claim 1, wherein the first cabinet includes a first baffle plate at its front, the second cabinet includes a second baffle plate at its front, and the second baffle plate has a diameter equal to or larger than half of a wavelength calculated from a bass reproduction limit frequency for the second speaker.

6. The speaker device according to claim 1, wherein the first cabinet includes a first baffle plate at its front, the second cabinet includes a second baffle plate at its front, and the first baffle plate and the second baffle plate are flush with each other.

7. The speaker device according to claim 1, wherein the first cabinet includes a first baffle plate at its front, the second cabinet includes a second baffle plate at its front, and the first baffle plate and the second baffle plate are integral with each other.

8. A speaker device, comprising:

a first speaker that is housed in a first cabinet and is attached to a first baffle plate closing a front opening of the first cabinet with an annular portion disposed there between;

a second cabinet arranged inside the sound path and spaced apart from the sound path, the sound path being annular; and a second speaker that radiates sound in a direction in which the first speaker radiates sound and that is stored in the second cabinet, a sound path that guides sound radiated from the first speaker to outside the first cabinet via a slit, the sound path being positioned on a sound radiation side of the first speaker and arranged annularly so as to surround a diaphragm in the first speaker, the slit being provided between the first baffle plate and a second baffle plate at the front of the second cabinet; and a resonant space that surrounds the annular portion and has an aperture that has one or more openings provided on the annular portion communicating with the sound path, wherein the resonant space suppresses a resonance of the sound that is radiated from the first speaker to outside the first speaker through the slit, and wherein the second cabinet has a back side facing the diaphragm in the first speaker and having a shape conforming to a shape of the diaphragm in the first speaker.

9. The speaker device according to claim 8, wherein the aperture of the resonant space communicates with the sound path and is located around the second speaker cabinet.

10. The speaker device according to claim 9, wherein the resonant space has two parts, one of the two parts is located inside of the second speaker cabinet, another of the two parts is located outside of the second speaker cabinet, and the sound path is located between the two parts.

* * * * *